US009532424B2

(12) United States Patent
Arulandu et al.

(10) Patent No.: US 9,532,424 B2
(45) Date of Patent: Dec. 27, 2016

(54) DIMMER AND LED DRIVER WITH DIMMING MODES

(71) Applicant: PHILIPS LIGHTING HOLDING B.V., Eindhoven (NL)

(72) Inventors: Kumar Arulandu, Breda (NL); Dmytro Viktorovych Malyna, Eindhoven (NL); Harald Josef Günther Radermacher, Aachen (DE); Lucas Louis Marie Vogels, Herten (NL); Ralph Kurt, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 14/782,450

(22) PCT Filed: Mar. 28, 2014

(86) PCT No.: PCT/IB2014/060246
§ 371 (c)(1),
(2) Date: Oct. 5, 2015

(87) PCT Pub. No.: WO2014/162247
PCT Pub. Date: Oct. 9, 2014

(65) Prior Publication Data

US 2016/0044758 A1 Feb. 11, 2016

Related U.S. Application Data

(60) Provisional application No. 61/807,977, filed on Apr. 3, 2013.

(51) Int. Cl.
*H05B 37/02* (2006.01)
*H05B 33/08* (2006.01)

(52) U.S. Cl.
CPC ..... *H05B 33/0845* (2013.01); *H05B 33/0815* (2013.01); *H05B 37/02* (2013.01)

(58) Field of Classification Search
CPC ..... H05B 37/02
(Continued)

(56) References Cited

U.S. PATENT DOCUMENTS 8,115,419 B2 2/2012 Given et al.
2002/0153852 A1 10/2002 Liao et al.
(Continued)

FOREIGN PATENT DOCUMENTS

EP 0991304 A1 4/2000
JP 2009123681 A 6/2009
(Continued)

OTHER PUBLICATIONS

"LED Integrated Dimmer", America Lighting Retrofit, Jan. 22, 2013, pp. 1-2. www.alrled.com/products/6_Channel_integrated_Dimmer.htm.

*Primary Examiner* — Tung X Le

(57) ABSTRACT

Drivers (2) comprise converters (21) for converting input signals from dimmers (1) into output signals destined for light emitting diode circuits (3) and controllers (22) for detecting dimming levels of the input signals and for bringing the drivers (2) from first, normal dimming modes into second, eco dimming modes in response to detection results defining the dimming levels being equal to/smaller than threshold levels. In the first/second dimming modes, the first input signals are converted into first/second output signals according to first/second curves (I, II). The second curves (II) define higher light outputs than the first curves (I) for most of the dimming levels. Dimmers (1) comprise indicators (11, 2, 13) for indicating to users the dimming levels of the input signals being equal to/smaller than the threshold levels. The indicators (11, 12, 13) may comprise light
(Continued)

emitting diode 10 apparatuses (11), mechanical clicks when turning knobs (12) and markers or markings (13) on the dimmer.

19 Claims, 8 Drawing Sheets

(58) Field of Classification Search
USPC ..... 315/294, 297, 307, 360, 362
See application file for complete search history.

(56) References Cited

U.S. PATENT DOCUMENTS

| | | | | |
|---|---|---|---|---|
| 2011/0043129 | A1 | 2/2011 | Koolen | |
| 2011/0068689 | A1 | 3/2011 | Scenini et al. | |
| 2011/0068704 | A1 | 3/2011 | McKinney | |
| 2011/0162946 | A1* | 7/2011 | Altonen | H01H 13/023 200/33 R |
| 2012/0161665 | A1* | 6/2012 | Thornton | H05B 33/0854 315/291 |
| 2012/0200229 | A1* | 8/2012 | Kunst | H05B 33/0815 315/186 |
| 2012/0262084 | A1 | 10/2012 | Liu | |
| 2012/0319621 | A1* | 12/2012 | Sutardja | H05B 33/0815 315/307 |
| 2013/0057173 | A1 | 3/2013 | Yao et al. | |
| 2013/0342122 | A1* | 12/2013 | Sawada | H03K 17/51 315/200 R |

FOREIGN PATENT DOCUMENTS

| | | | |
|---|---|---|---|
| WO | 2009094329 | A1 | 7/2009 |
| WO | 2009136328 | A1 | 11/2009 |

* cited by examiner

DIMMER AND LED DRIVER WITH DIMMING MODES

CROSS-REFERENCE TO PRIOR APPLICATIONS

This application is the U.S. National Phase application under 35 U.S.C. §371 of International Application No. PCT/IB14/060246, filed on Mar. 28, 2014, which claims the benefit of U.S. Provisional Patent Application No. 61/807,977, filed on Apr. 3, 2013. These applications are hereby incorporated by reference herein.

FIELD OF THE INVENTION

The invention relates to a driver comprising a converter for converting an input signal from a dimmer into an output signal destined for a light emitting diode circuit. The invention further relates to a device comprising a driver and a light emitting diode circuit, and to a dimmer for supplying an input signal to a driver having a first dimming mode and a second dimming mode.

Examples of such a driver are LED drivers and parts thereof. Examples of such a device are lamps and parts thereof. Examples of such a dimmer are AC dimmers.

BACKGROUND OF THE INVENTION

US 2012/0262084 A1 discloses a dimmable light emitting diode driver that is compatible with all kinds of dimmers.

US 2013/0057173 A1 discloses a primary side controlled switched mode power supply for driving LEDs.

The NEMA SSL6 standard defines upper and lower limits for a dimming curve.

SUMMARY OF THE INVENTION

It is an object of the invention to provide an improved driver. Further objects of the invention are to provide an improved device and an improved dimmer.

According to a first aspect, a driver is provided comprising a converter for converting an input signal from a dimmer into an output signal destined for a light emitting diode circuit, and a controller for detecting a dimming level of the input signal and for, in response to a detection result defining the dimming level being equal to or smaller than a threshold level, bringing the driver from a first dimming mode into a second dimming mode, the converter being configured to, in the first dimming mode, convert first input signals into first output signals according to a first curve, and to, in the second dimming mode, convert the first input signals into second output signals according to a second curve, the first and second curves each defining a light output per dimming level, and the second curve defining a higher light output than the first curve for most of the dimming levels.

A converter converts an input signal from a dimmer into an output signal destined for a light emitting diode circuit. Examples of such a converter are a DC-DC-converter, a combination of a rectifier and a DC-DC-converter, an AC-DC-converter and a switched mode power supply etc. without having excluded other kinds of converters.

A controller detects a dimming level of the input signal. In response to a detection result that defines that the dimming level is equal to or smaller than a threshold level, the driver is brought from a first dimming mode into a second dimming mode. The converter is configured to, in the first dimming mode, convert first input signals into first output signals according to a first curve, and to, in the second dimming mode, convert the first input signals into second output signals according to a second curve. These first and second curves each define a light output per dimming level, as is also done by the NEMA SSL6 standard. The second curve shows a higher light output than the first curve for most of the dimming levels. So, in the second dimming mode, compared to the first dimming mode, more light is produced by the light emitting diode circuit for a given dimming level. This is a great improvement: The first dimming mode is suited to dim incandescent light circuits as well, that show a lower efficiency than light emitting diode circuits, where the second dimming mode allows the light emitting diode circuits to be dimmed at a higher efficiency.

The detection result that defines that the dimming level is equal to or smaller than a threshold level may comprise a detection result in the form of the dimming level dropping to or below the threshold level or may comprise a detection result in the form of the dimming level being at or below the threshold level for a minimum amount of time or may comprise any other detection result defining that the dimming level is equal to or smaller than the threshold level. Some dimmers start, at power-on, at an arbitrary dimming level larger than the threshold level. As soon as the dimming level drops to and/or passes the threshold level, the driver may go from the first dimming mode into the second dimming mode. Other dimmers start, at power-on, at a minimum dimming level. In this case, either the driver may immediately detect that the minimum dimming level is below the threshold level and go into the second dimming mode, or the driver may detect that the minimum dimming level is below the threshold level for a duration of at least a minimum time-interval and go into the second dimming mode, or the driver may firstly wait until a dimming level higher than the threshold level has been chosen by a user and from then on may secondly wait until the dimming level drops to and/or passes the threshold level and go into the second dimming mode etc.

A light emitting diode circuit comprises one or more light emitting diodes of whatever kind and in whatever combination. A third dimming mode is not to be excluded, for example in response to a detection result that defines that the dimming level is equal to or smaller than another threshold level for example lower than the threshold level etc.

An embodiment of the driver is defined by the controller being configured to, at power-on, start the driver in the first dimming mode, and to, after having brought the driver into the second dimming mode, keep the driver in the second dimming mode until power-off. At power-on, the driver is started in the first dimming mode, either at a given dimming level or going up from zero to a certain dimming level. As soon as the driver has been brought into the second dimming mode, it should stay in this second dimming mode until power-off.

According to a first driver option, when going into the second dimming mode, the light emitting diode circuit may get a higher light output in a smooth way or a non-smooth way. Thereafter it can be dimmed further down or up in the second dimming mode. According to a second driver option, when going into the second dimming mode, the light emitting diode circuit may maintain a certain light output where further dimming down may improve an efficiency. A user may experience a seamless transition from the first dimming mode to the second dimming mode or may experience one or more jumps in the light output.

An embodiment of the driver is defined by the dimming level being a phase-cut angle, and the threshold level being a threshold angle. Phase-cut dimmers are used world-wide to dim incandescent light circuits and light emitting diode circuits.

An embodiment of the driver is defined by the threshold angle being equal to or smaller than 35 degrees. Preferably, the threshold angle should be larger than a minimum number of degrees such that sufficient power can be transferred to the dimmer and the light emitting diode circuit in order keep the driver functioning.

An embodiment of the driver is defined by the controller comprising a detector for detecting the dimming level and a generator for in response to a detection result from the detector generating a control signal for controlling the converter. Said dimming level may be detected by for example detecting a phase-cut angle and/or a zero-crossing in the input signal or by for example detecting an average value of an amplitude of the input signal or an amount of power present in the input signal etc. Such a detector is itself common in the art as also shown in the patent applications cited above. Said generator may have one or more out of many embodiments.

An embodiment of the driver is defined by the first dimming mode being a normal dimming mode, and the second dimming mode being an eco dimming mode. In the eco dimming mode, a higher efficiency is reached.

An embodiment of the driver is defined by the driver, in the first dimming mode, necessarily operating in accordance with an existing standard, and, in the second dimming mode, not necessarily operating in accordance with this existing standard. The existing standard allows incandescent light circuits as well as light emitting diode circuits to be dimmed, the second dimming mode is designed for light emitting diode circuits in particular.

According to a second aspect, a device is provided comprising the driver as defined above and further comprising the light emitting diode circuit.

An embodiment of the device is defined by the light emitting diode circuit, in the second dimming mode, being operated at a higher efficiency than in the first dimming mode.

According to a third aspect, a dimmer is provided for supplying an input signal to a driver having a first dimming mode and a second dimming mode, the dimmer comprising an indicator for indicating to a user a dimming level of the input signal being equal to or smaller than a threshold level.

An embodiment of the dimmer is defined by further comprising a controller for keeping the indicator activated in case the dimming level of the input signal has exceeded the threshold level. The controller reminds the user of the driver being brought into the second dimming mode. Once being brought into the second dimming mode, the driver will stay in this second dimming mode.

An embodiment of the dimmer is defined by further comprising a controller for starting the dimmer at a first dimming level of the input signal equal to or smaller than the threshold level even in case the user has selected a second dimming level larger than the threshold value and for going from the first dimming level to the second dimming level in a smooth way or in a non-smooth way. A certain dimmer can be started by a user at a second dimming level larger than a threshold value. In that case, to inform a driver that a second dimming mode is possible, this dimmer should start at a first dimming level equal to or smaller than the threshold level. Shortly after that, this dimmer should go the second dimming level selected by the user smoothly through a seamless transition or non-smoothly via one or more jumps.

An embodiment of the dimmer is defined by the indicator comprising a light emitting diode apparatus that informs the user when the dimming level of the input signal is equal to or smaller than the threshold level. The light emitting diode apparatus for example comprises a single diode that is switched on when the dimming level has reached a particular dimming level or that changes its color when the dimming level has reached a particular dimming level etc.

An embodiment of the device is defined by the indicator comprising a mechanical click when turning a knob of the dimmer near the threshold level. The user can feel and/or hear the mechanical click.

An embodiment of the device is defined by the indicator comprising a marker or a marking on the dimmer. The user can see the marker or the marking on the dimmer.

Preferably, the dimming level may be a phase-cut angle, and the threshold level being a threshold angle. Preferably, the threshold angle may be equal to or smaller than 35 degrees.

So, according to a first dimmer option, the dimmer may power up at a lower dimming level than the threshold level, and increase towards a last dimming level at which it was turned off. According to a second dimmer option, a user may dim all the way down and up again to enable the second dimming mode in the driver.

An insight is that light emitting diode circuits allow higher efficiencies than incandescent light circuits. A basic idea is that the driver should have at least a standard dimming mode and another dimming mode to be entered in response to a detection result defining the dimming level being equal to or smaller than a threshold level.

A problem to provide an improved driver has been solved. A further advantage is that higher efficiencies for light emitting diode circuits in relatively low power dimming modes have become possible.

These and other aspects of the invention will be apparent from and elucidated with reference to the embodiments described hereinafter.

DETAILED DESCRIPTION OF EMBODIMENTS

Figure 1:
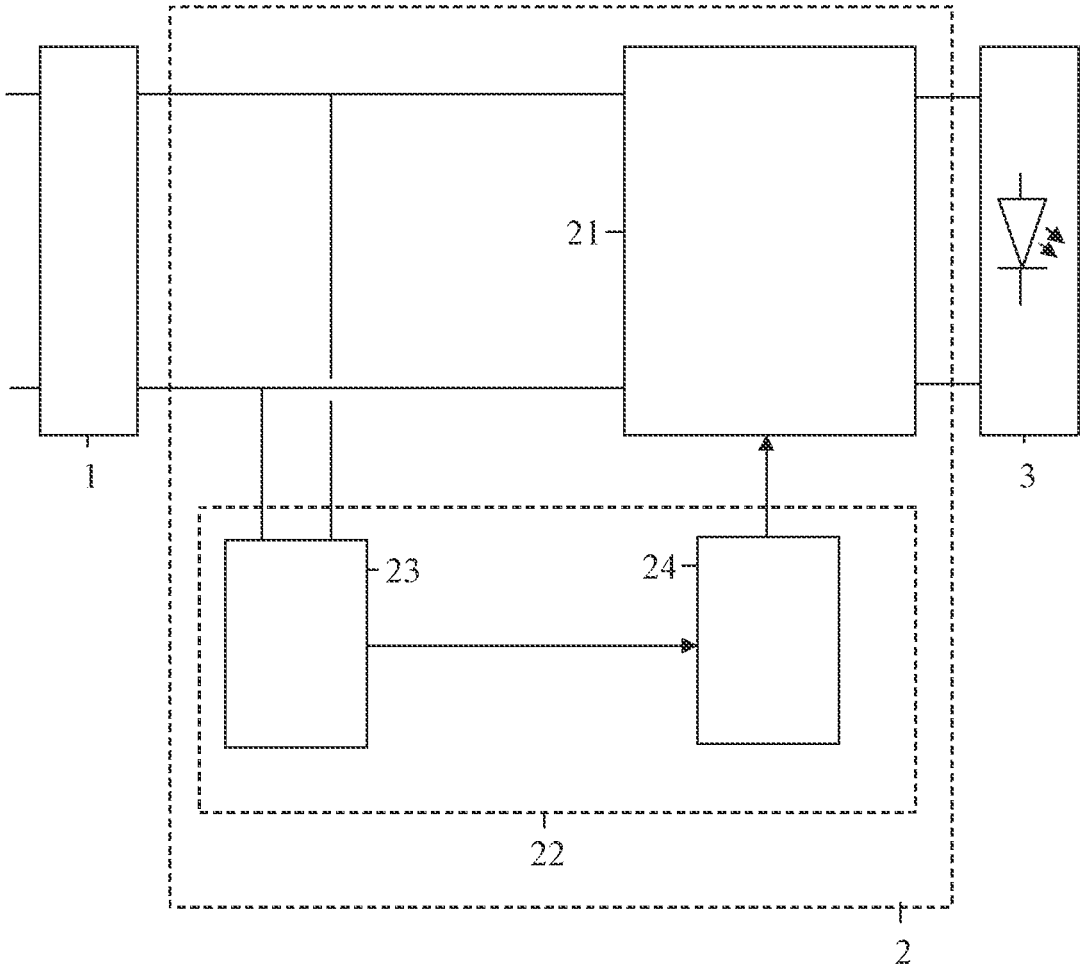
FIG. 1 shows a first embodiment of driver.

In the FIG. 1, a first embodiment of driver 2 is shown. The driver 2 comprises a converter 21 with inputs to be coupled to outputs of a dimmer 1 such as a phase-cut dimmer and with outputs to be coupled to a light emitting diode circuit 3 such as a light emitting diode lamp. The driver 2 further comprises a controller 22 for controlling the converter 21.

The converter 21 converts an input signal coming from the dimmer 1 into an output signal destined for the light emitting diode circuit 3. The controller 22 detects a dimming level of the input signal and brings the driver 2 from a first dimming mode into a second dimming mode in response to a detection result defining the dimming level being equal to or smaller (lower) than a threshold level. The converter 21 is configured to, in the first dimming mode, convert first input signals into first output signals according to a first curve I as shown in the FIG. 4, and to, in the second dimming mode, convert the first input signals into second output signals according to a second curve II as shown in the FIG. 4. The first and second curves I, II each define a relative light output per dimming level, whereby the second curve II is defining a higher light output than the first curve I for most of the dimming levels as also discussed at the hand of the FIG. 4. Alternatively, the first and second curves I, II may each define an absolute light output per dimming level, for example for a given light emitting diode circuit 3.

Figure 4:
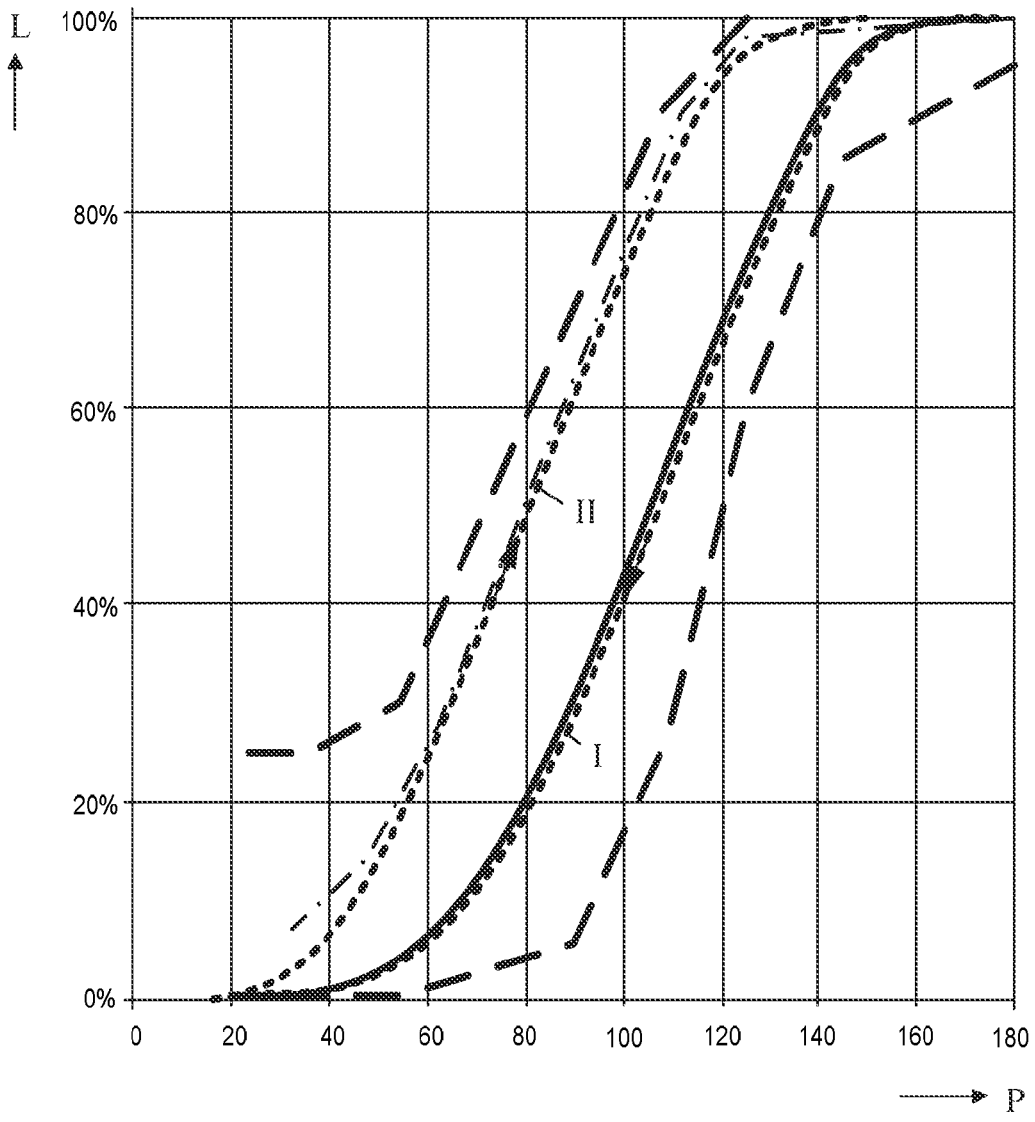
FIG. 4 shows first and second curves, two limiting curves, an incandescent curve and an efficiency curve.

Preferably, the controller 22 is configured to, at power-on, start the driver 2 in the first dimming mode, and to, after having brought the driver 2 into the second dimming mode, keep the driver 2 in the second dimming mode until power-off as also discussed at the hand of the FIG. 4. Many different embodiments will be possible here, as also described elsewhere.

For a dimmer 1 in the form of a phase-cut dimmer, the dimming level may be a phase-cut angle, and the threshold level may be a threshold angle. In that case, the threshold angle may be equal to or smaller than 35 degrees, and the controller 22 may comprise a detector 23 for detecting the dimming level such as for example a phase-cut angle and/or a zero-crossing in the input signal. Other kinds of dimmers and other kinds of dimming levels are not to be excluded, such as amplitude dimmers and amplitude levels, pulse width modulation dimmers and pulse width modulation levels etc. Other kinds of detectors are not to be excluded, such as detectors for detecting average values of amplitudes of the input signals or amounts of power present in the input signals etc.

The first dimming mode may be a normal dimming mode, and the second dimming mode may be an eco dimming mode. The driver 2 operates, in the first dimming mode, necessarily in accordance with an existing standard, such as for example the NEMA SSL6 standard, and, in the second dimming mode, does not necessarily operate in accordance with this existing standard.

The controller 22 may further comprise a processor 24 for translating a detection result from the detector 23 into a control signal for the converter 21. In this case, the processor 24 may bring the driver 2 from the first dimming mode into the second dimming mode, by making the control signal dependent upon the kind of mode, in response to a detection result from the detector 23 defining the dimming level being equal to or smaller (lower) than a threshold level etc. Alternatively, the detector 23 may be integrated into the processor 24, with the processor 24 performing the detection and bringing the driver 2 into another mode etc. The processor 24 may further comprise a memory not shown and may perform a calculation on the detection result to calculate the control signal etc. The controller 22 may be powered via the converter 21 or via an auxiliary power source or otherwise. Instead of and/or in addition to the digital embodiments realized via the processor 24, analog embodiments may be introduced, such as analog latches for changing the curves etc.

Figure 2:
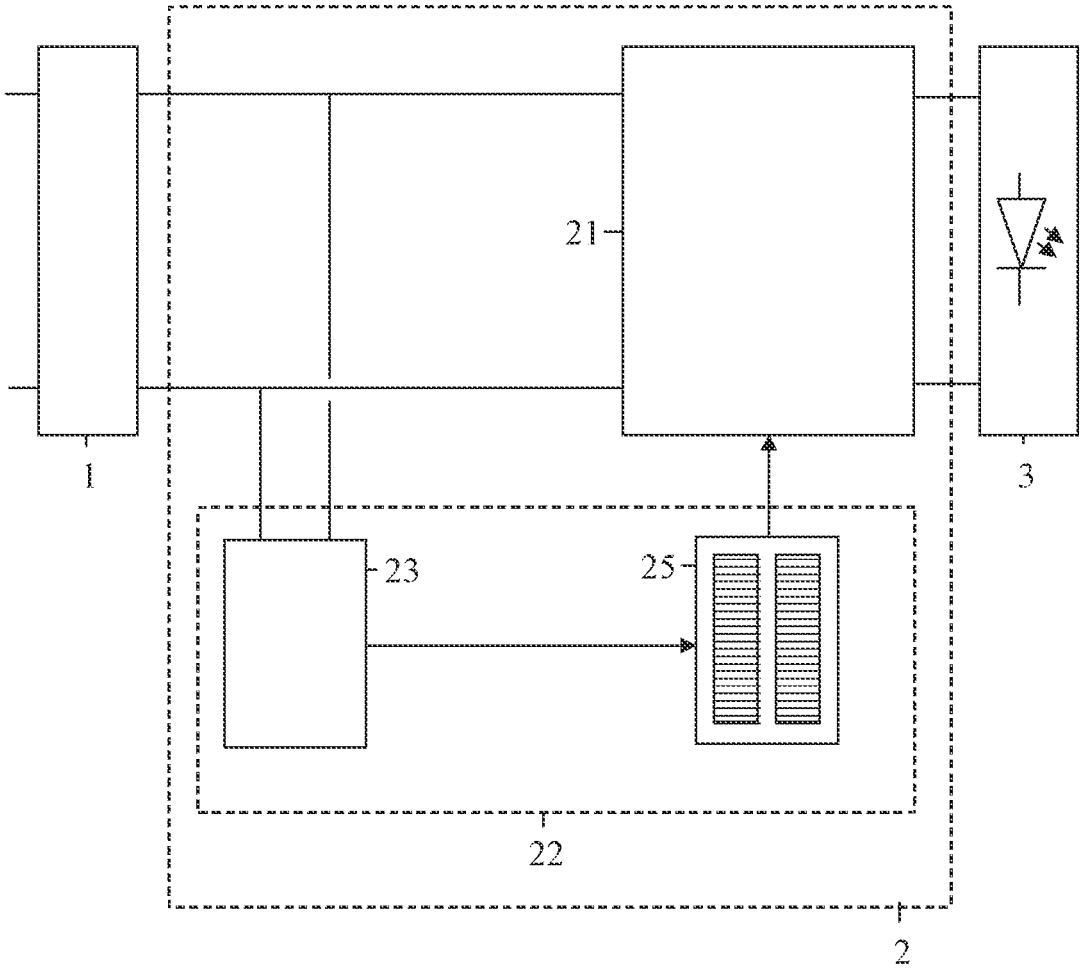
FIG. 2 shows a second embodiment of a driver.

In the FIG. 2, a second embodiment of a driver 2 is shown, that differs from the first embodiment in that the controller 22 here comprises a processor 25 for translating a detection result from the detector 23 into a control signal for the converter 21 at the hand of two tables. In this case, in the first dimming mode, the processor 25 uses a first table for converting the detection result into the control signal. As soon as it has been determined, for example by the processor 25, that the dimming level has become equal to or smaller (lower) than a threshold level, the processor 25 may bring the driver 2 from the first dimming mode into the second dimming mode by starting to use a second table and from then on uses the second table for converting the detection result into the control signal. Again, alternatively, the detector 23 may be integrated into the processor 25, with the processor 25 performing the detection and bringing the driver 2 into another mode etc.

Figure 3:
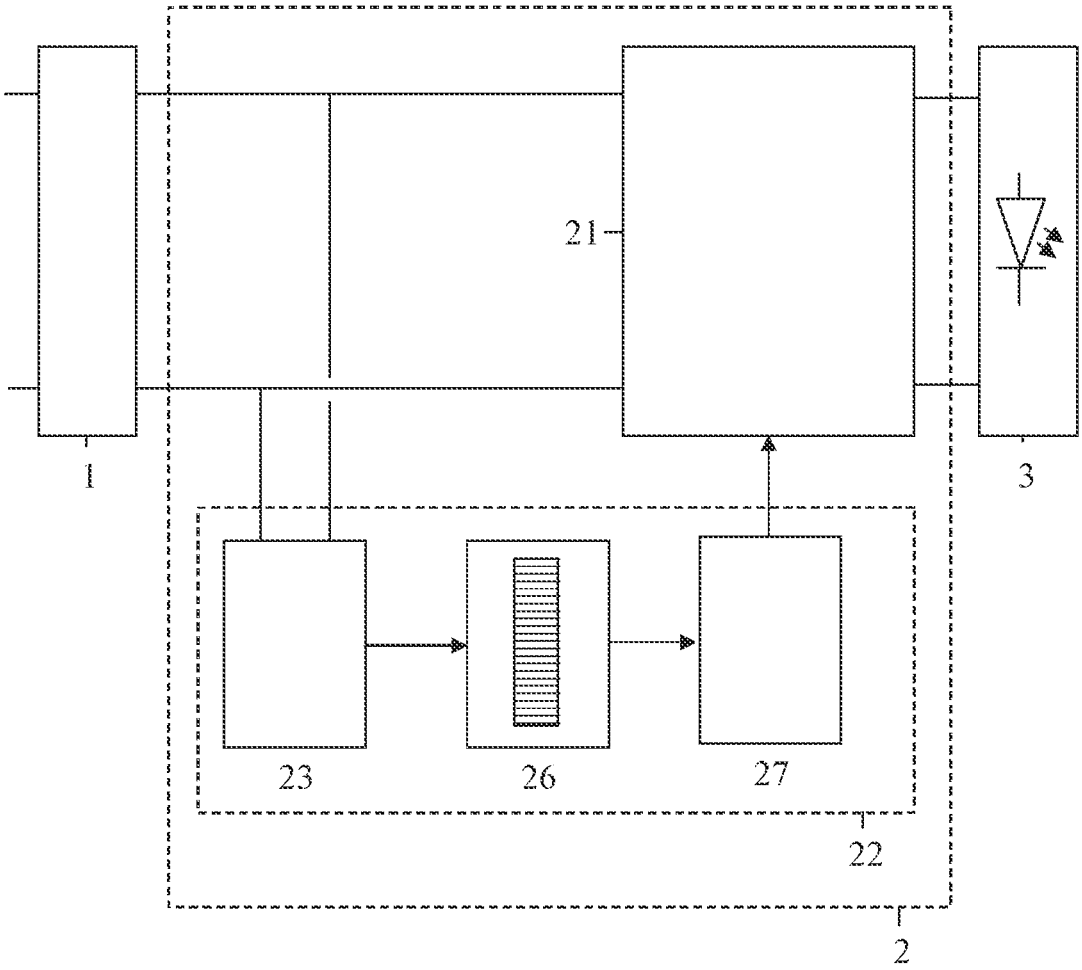
FIG. 3 shows a third embodiment of a driver.

In the FIG. 3, a third embodiment of a driver 2 is shown, that differs from the first and second embodiments in that the controller 22 here comprises a memory 26 with a table for translating a detection result from the detector 23 into a control signal for the converter 21. The controller 22 further comprises an adaptation circuit 27 for adapting the control signal in dependence of the mode of the driver 2. So, in this case, in the first dimming mode, the adaptation circuit 27 does not adapt the control signal. As soon as it has been detected that the dimming level has become equal to or smaller (lower) than a threshold level, for example by the adaptation circuit 27, the adaptation circuit 27 may bring the driver 2 from the first dimming mode into the second dimming mode by from this moment on adapting the control signal to get another control signal etc. Again, alternatively, each one or two of the units 23, 26 and 27 may be integrated into the remaining one or two etc.

In the FIG. 1-3, the processor 24, the processor 25 and the combination of the memory 26 and the adaptation circuit 27 are embodiments of a generator 24-27 for in response to a detection result from the detector 23 generating a control signal for controlling the converter 21. Clearly, the FIG. 1-3 are embodiments only. Many more embodiments will be possible, for example by combining two or more of these FIG. 1-3 with each other etc. and/or by combining parts from two or more of these FIG. 1-3 with each other etc. The converter 21 and the controller 22 may be a fully integrated module or not.

In the FIG. 4, first and second curves I and II, two limiting curves, an incandescent curve and an efficiency curve are shown. The vertical axis defines a relative light output L (0%-100%), and the horizontal axis defines a dimming level here in the form of a phase-cut P (0 degrees-180 degrees). At power-on, the driver 2 starts in a first dimming mode and the first curve I is followed up and down, until it is detected that the dimming level is equal to or smaller (lower) than a threshold level. Then, the driver 2 is brought from the first dimming mode into a second dimming mode, and from that moment on, the second curve II is followed up and down until a power-off. For the transition from the first dimming mode to the second dimming mode, many embodiments will be possible, as also described elsewhere. The converter 21, in the first dimming mode, converts first input signals into first output signals according to the first curve I, and, in the second dimming mode, converts the first input signals into second output signals according to the second curve II. The second curve II defines a higher light output than the first curve I for most of the dimming levels. A first limiting curve (left graph with long stripes) and a second limiting curve (right graph with long stripes) show limits as standardized. An incandescent curve (continuous line) between the limiting curves shows a behavior of an incandescent lamp. An (ideal) efficiency curve (stripes and dots) shows a behavior resulting in an (ideal) efficiency. The first curve I should be located between or in an extreme case on the limiting curves. The second curve II may be located outside an area situated between these limiting curves.

Figure 5:
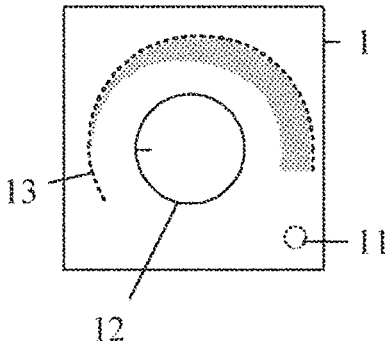
FIG. 5 shows an embodiment of a dimmer.

In the FIG. 5, an embodiment of a dimmer 1 is shown. The dimmer 1 supplies an input signal to a driver 2 having a first dimming mode and a second dimming mode. The dimmer 1 comprises an indicator 11, 12, 13 for indicating to a user a dimming level of the input signal being equal to or smaller than a threshold level. The indicator 11, 12, 13 may comprise a light emitting diode apparatus 11 that informs the user when the dimming level of the input signal is equal to or smaller (lower) than the threshold level, for example by being switched on or by changing its color when the dimming level has reached a particular dimming level etc. The indicator 11, 12, 13 may comprise a mechanical click when turning a knob 12 of the dimmer 1 near the threshold level and/or may comprise a marker or a marking 13 on the dimmer 1. The marker or the marking 13 for example comprises a dashed line surrounding a gray surface and being a bit longer than said gray surface, with the gray surface defining the normal dimming mode and with the dashed line defining the eco dimming mode. In every one of these cases, the user is informed about said threshold level being passed and/or being approached etc. Some conventional dimmers have accessible potentiometers in order to adjust a minimum level and/or a maximum level. If the minimum level of this dimmer is adjusted to a level below the threshold value, the second dimming mode of the driver 2 may be activated etc.

Figure 6:
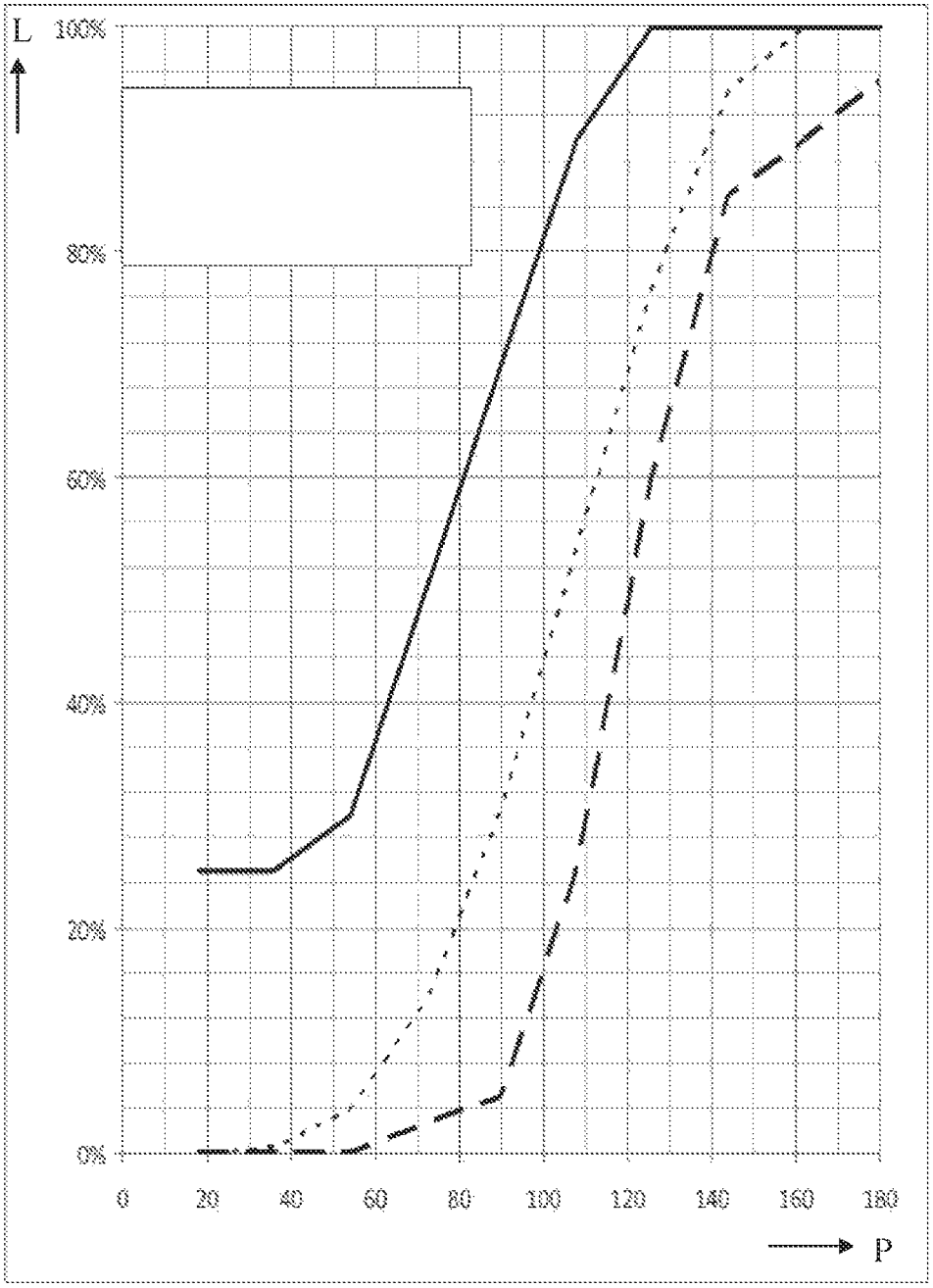
Fig. 6 (prior art)
FIG. 6 shows a prior art standard.

In the FIG. 6, a prior art standard is shown, with a first limiting curve (left graph with a continuous line) and a second limiting curve (right graph with long stripes) and an (informative) incandescent graph (dotted line) in between.

Figure 7:
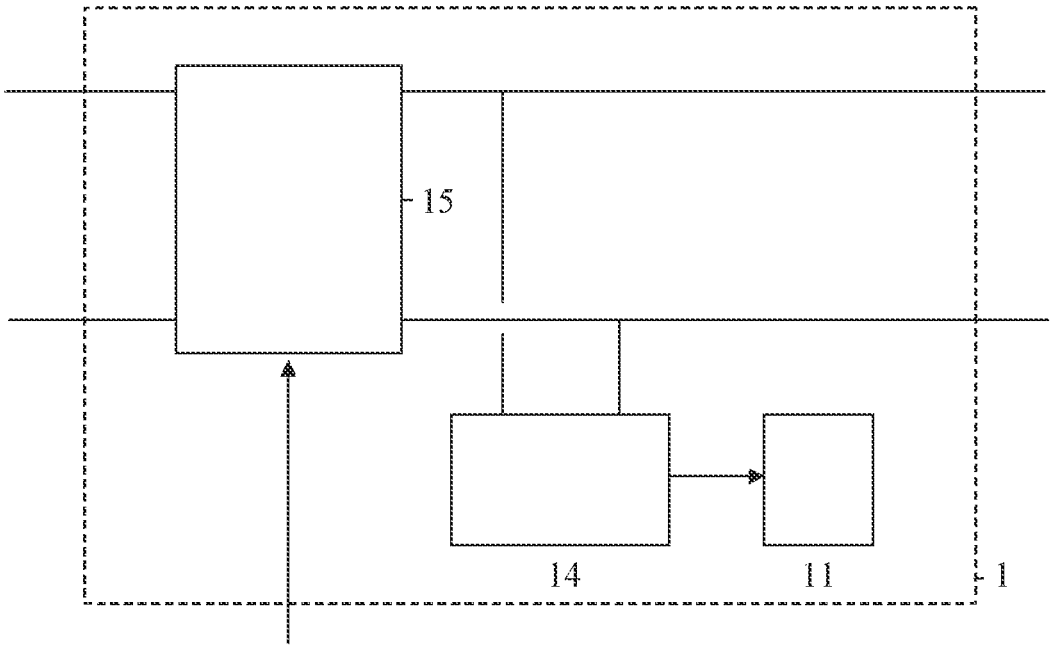
FIG. 7 shows a first embodiment of a dimmer.

In the FIG. 7, a first embodiment of a dimmer 1 is shown. The dimmer 1 comprises a phase-cutter 15 controlled via a user input and further comprises a controller 14 here mainly for detecting the dimming level as described for the FIG. 1-3. In response to a detection result, the controller 14 controls an indicator here in the form of a light emitting diode apparatus 11 for indicating to a user a dimming level of the input signal being equal to or smaller/lower than a threshold level. Preferably, the controller 14 keeps the indicator activated once the dimming level of the input signal has exceeded the threshold level.

Figure 8:
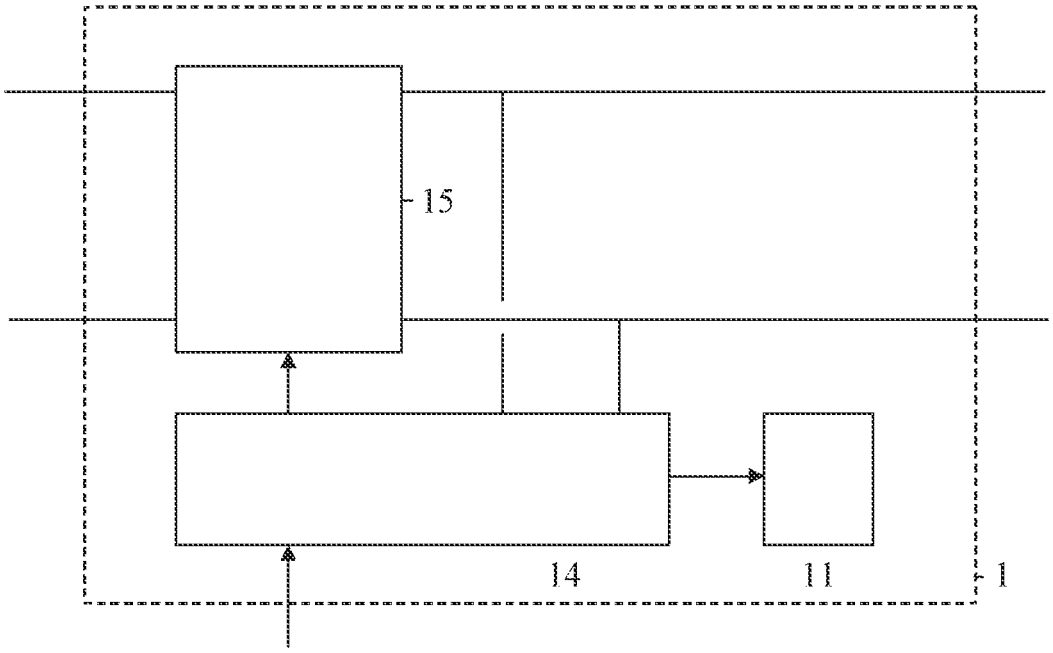
FIG. 8 shows a second embodiment of a dimmer.

In the FIG. 8, a second embodiment of a dimmer 1 is shown. This second embodiment differs from the first embodiment in that the user input is supplied to the controller 14 that here controls the phase-cutter 15. Said detection performed by the controller 14 may in this case be present or not. Preferably, the controller 14 starts the dimmer at a first dimming level of the input signal equal to or smaller/lower than the threshold level independently from the user input when requesting a second dimming level larger than the threshold value. The controller 14 then controls the phase-cutter 15 such that the dimmer 1 goes from the first dimming level to the requested second dimming level in a smooth way (seamlessly) or in a non-smooth way (via one or more jumps).

Figure 9:
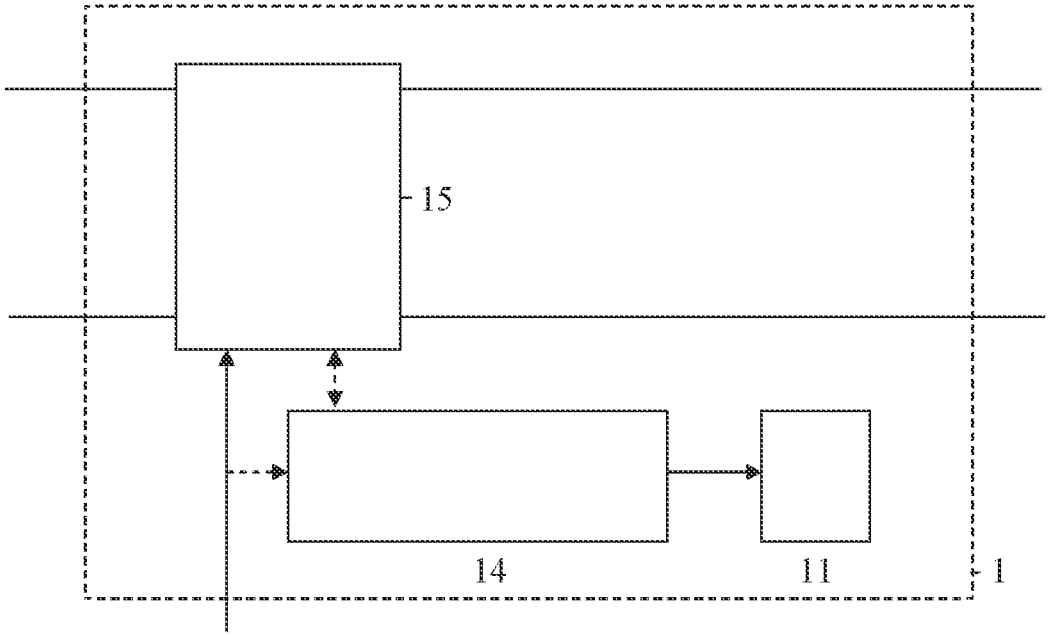
FIG. 9 shows a third embodiment of a dimmer.

In the FIG. 9, a third embodiment of a dimmer 1 is shown. This third embodiment differs from the first embodiment in that the controller 14 detects a dimming level either via a user input as supplied to the phase-cutter 15 or via a feedback from the phase-cutter 15. Further, the controller 14 may control the phase-cutter 15 or not.

Figure 10:
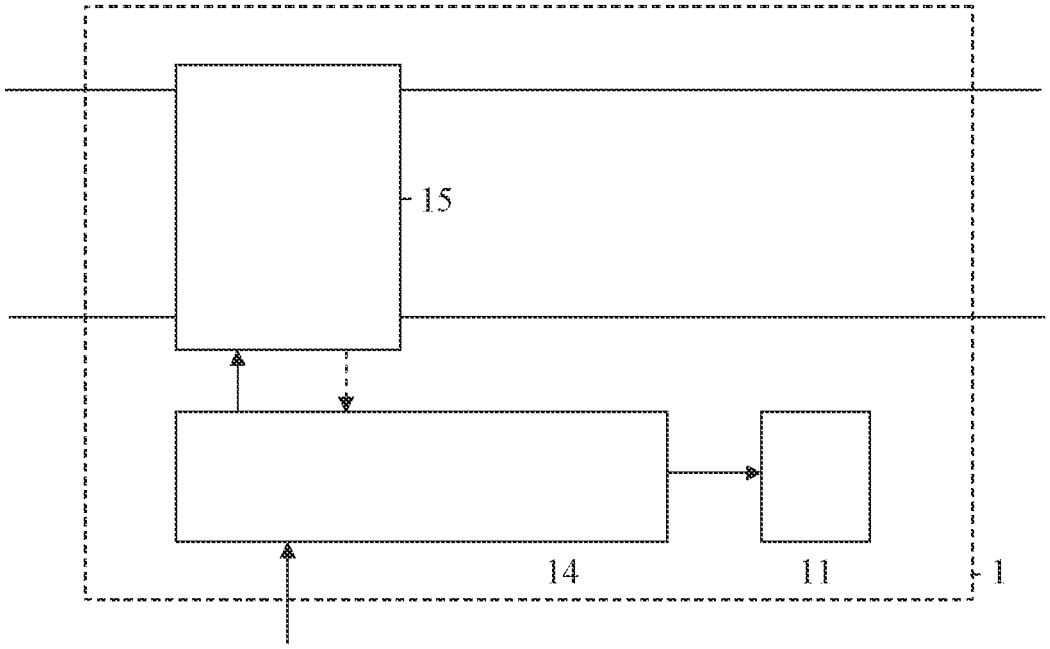
FIG. 10 shows a fourth embodiment of a dimmer.

In the FIG. 10, a fourth embodiment of a dimmer 1 is shown. This fourth embodiment differs from the second embodiment in that the controller 14 detects a dimming level either via a user input as supplied to the controller 14 or via a feedback from the phase-cutter 15. Further, here the controller 14 controls the phase-cutter 15.

Clearly, the FIGS. 7-10 are embodiments only. Many more embodiments will be possible. The controller 14, the detection function of the controller 14, the user input adaptation function of the controller 14, the light emitting diode apparatus 11 and the phase-cutter 15 are examples only. The controller 14 and the phase-cutter 15 or its alternative may be a fully integrated module or not.

In other words, the driver 2 and the dimmer 1 allow relatively low power dimming. A prior art current waveform is extracted by the driver 2 from the dimmer 1 in order to ensure compatibility with the dimmer 1. This prior art current waveform causes energy waste in the relatively low power light emitting diode circuits 3 in a dimmed operation in view of requirements of the dimmer 1 and an aim to follow an equivalent dimming curve of an incandescent lamp. By letting the driver 2 shift this dimming curve, the input power is no longer wasted as much as it used to be. Compared to the improved driver 2, a prior art driver will result in a relatively high light output at a relatively low dimming level or it will result in a relatively large efficiency loss in order to follow the dimming curve of the incandescent lamp.

Summarizing, drivers 2 comprise converters 21 for converting input signals from dimmers 1 into output signals destined for light emitting diode circuits 3 and controllers 22 for detecting dimming levels of the input signals and for bringing the drivers 2 from first, normal dimming modes into second, eco dimming modes in response to detection results defining the dimming levels being equal to/smaller than threshold levels. In the first/second dimming modes, the first input signals are converted into first/second output signals according to first/second curves I, II. The second curves II define higher light outputs than the first curves I for most of the dimming levels. Dimmers 1 comprise indicators 11, 12, 13 for indicating to users the dimming levels of the input signals being equal to/smaller than the threshold levels. The indicators 11, 12, 13 may comprise light emitting diode apparatuses 11, mechanical clicks when turning knobs 12 and markers or markings 13 on the dimmer.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A device including a driver, the driver comprising a converter for converting an input signal from a dimmer into an output signal destined for a light emitting diode circuit, and a controller for detecting a dimming level of the input signal and for, in response to a detection result defining the dimming level being equal to or smaller than a threshold level, bringing the driver from a first dimming mode into a second dimming mode, the converter being configured to, in the first dimming mode, convert first input signals into first output signals according to a first curve (I), and to, in the second dimming mode, convert the first input signals into second output signals according to a second curve (II), the first and second curves (I, II) each defining a light output per dimming level, and the second curve (II) defining a higher light output than the first curve (I) for most of the dimming levels.

2. The device of claim 1, the controller being configured to, at power-on, start the driver in the first dimming mode, and to, after having brought the driver into the second dimming mode, keep the driver in the second dimming mode until power-off.

3. The device of claim 1, the dimming level being a phase-cut angle, and the threshold level being a threshold angle.

4. The device of claim 3, the threshold angle being equal to or less than 35 degrees.

5. The device of claim 1, the controller comprising:

a detector for detecting the dimming level; and a generator for, in response to a detection result from the detector, generating a control signal for controlling the converter.

6. The device of claim 1, the first dimming mode being a normal dimming mode, and the second dimming mode being an eco dimming mode.

7. The device of claim 1, further comprising the light emitting diode circuit.

8. The device of claim 7, the light emitting diode circuit being operated in the second dimming mode at a higher efficiency than in the first dimming mode.

9. The device of claim 1, wherein the controller includes:

a processor;

a first table usable by the processor to translate the detected dimming level into a control signal to cause the converter to convert the first input signals into the first output signals according to the first curve (I) in the first dimming mode; and a second table usable by the processor to translate the detected dimming level into the control signal to cause the converter to convert the first input signals into the second output signals according to the second curve (I) in the second dimming mode.

10. A dimmer, comprising:

output terminals for supplying an input signal to a driver for driving a light emitter, the input signal causing the driver to operate the light emitter in one of a first dimming mode and a second dimming mode, the light emitter being operated at a higher efficiency in the second dimming mode than in the first dimming mode;

an indicator for indicating to a user when the input signal supplied by the output terminal causes the driver to operate in the second dimming mode; and a controller for starting the dimmer at a first dimming level of the input signal equal to or smaller than the threshold level even in case the user has selected a second dimming level larger than the threshold value and for going from the first dimming level to the second dimming level in a smooth way or in a non-smooth way.

11. The dimmer of claim 10, wherein the input signal has a dimming level and wherein the dimmer supplies the input signal with the dimming level going below a threshold level to cause the driver to operate the light emitter in the second driving mode, the dimmer further comprising:

a controller for keeping the indicator activated in case the dimming level of the input signal has exceeded the threshold level.

12. The dimmer of claim 10, the indicator comprising a light emitting diode apparatus that informs the user when the dimming level of the input signal is equal to or smaller than the threshold level.

13. The dimmer of claim 10, the indicator comprising a mechanical click when turning a knob of the dimmer near the threshold level.

14. The dimmer of claim 10, the indicator comprising a marker or a marking on the dimmer.

15. A driver for driving a light emitting diode load, the driver comprising a converter configured to receive a phase-cut input signal from a phase-cut dimmer and in response thereto to produce an output signal for driving the LED load; and a controller configured to detect a phase-cut angle of the phase-cut input signal and, in response to the phase-cut angle being equal to or less than a threshold angle, to bring the driver from a first dimming mode into a second dimming mode, the converter further being configured to convert the phase-cut input signal into the output signal according to a first curve (I) in the first dimming mode, and to convert the phase-cut input signal into the output signal according to a second curve (II) in the second dimming mode, the first and second curves (I, II) each defining a light output corresponding to a given phase-cut angle, and the second curve (II) defining a higher light output than the first curve (I) for most phase-cut angles.

16. The driver of claim 15, wherein the controller is configured to start the driver in the first dimming mode at power-on, and, after having brought the driver into the second dimming mode, to keep the driver in the second dimming mode until power-off.

17. The driver of claim 16, wherein the driver is configured to cause the LED load to operate at a higher efficiency in the second dimming mode than in the first dimming mode.

18. The driver of claim 16, wherein the controller includes:

a processor;

a first table usable by the processor to translate the detected dimming level into a control signal for to cause the converter to convert the phase-cut input signal into the output signal according to the first curve (I) in the first dimming mode; and a second table usable by the processor to translate the detected dimming level into the control signal to cause the converter to convert the phase-cut input signal into the output signal according to the second curve (I) in the second dimming mode.

19. The driver of claim 16, wherein the controller includes:

a processor;

a first table usable by the processor to translate the detected dimming level into a control signal for to cause the converter to convert the phase-cut input signal into the output signal according to the first curve (I) in the first dimming mode; and an adaptation circuit configured to receive the control signal, and when the driver is in the second dimming mode to adapt the control signal to cause the converter to convert the phase-cut input signal into the output signal according to the second curve (I) in the second dimming mode.

* * * * *